US009247822B2

(12) United States Patent
Fischer

(10) Patent No.: US 9,247,822 B2
(45) Date of Patent: Feb. 2, 2016

(54) ITEM OF SEATING FURNITURE AND FITTING THEREFORE

(71) Applicant: Matthias Fischer, Bratislava (SK)

(72) Inventor: Matthias Fischer, Bratislava (SK)

(73) Assignee: KINTEC-SOLUTION GMBH, Rietberg (DE)

( * ) Notice: Subject to any disclaimer, the term of this patent is extended or adjusted under 35 U.S.C. 154(b) by 25 days.

(21) Appl. No.: 14/098,891

(22) Filed: Dec. 6, 2013

(65) Prior Publication Data

US 2014/0333108 A1 Nov. 13, 2014

(30) Foreign Application Priority Data

May 10, 2013 (EP) ..... 13167391

(51) Int. Cl.
*A47C 7/50* (2006.01)
*A47C 1/035* (2006.01)

(52) U.S. Cl.
CPC ..... *A47C 7/50* (2013.01); *A47C 1/0352* (2013.01)

(58) Field of Classification Search
CPC ..... A47C 1/034; A47C 1/035
USPC ..... 297/84
See application file for complete search history.

(56) References Cited

U.S. PATENT DOCUMENTS 2,875,813 A * 3/1959 Schliephacke ..... 297/88
2,875,814 A * 3/1959 Schliephacke ..... 297/84
2,943,670 A * 7/1960 Hoffman, Jr. ..... 297/89
3,010,761 A * 11/1961 Teague, Jr. ..... 297/84
3,061,367 A * 10/1962 Schliephacke ..... 297/89
3,100,668 A * 8/1963 Clark et al. ..... 297/89
3,233,938 A * 2/1966 Fletcher ..... 297/84
3,244,449 A * 4/1966 Re ..... 297/75
3,279,847 A * 10/1966 Re ..... 297/89

(Continued)

FOREIGN PATENT DOCUMENTS

BE 1009147 A3 12/1996
DE 37 18 645 A1 3/1988

(Continued)

OTHER PUBLICATIONS

European Search Report issued in European Application No. 13167391.5 with English translation of category of cited documents dated Nov. 7, 2013 (7 pages).

(Continued)

*Primary Examiner* — David R Dunn
*Assistant Examiner* — Timothy J Brindley
(74) *Attorney, Agent, or Firm* — Flynn, Thiel, Boutell & Tanis, P.C.

(57) ABSTRACT

An item of seating furniture, including a base fixed in position during use, a seat unit with a seat surface, and a leg unit moveable in relation to the seat unit and having a leg support surface. The leg unit is displaceable via a movement mechanism between a storage position and a use position.

The movement mechanism is designed for transferring the leg unit from the storage position into the use position. The movement mechanism has an intermediate support displaceable in relation to the seat unit or the base via a first pivoting guide. The pivoting guide has a first rear pivot lever between the intermediate support and the seat unit or the base, and the leg unit is displaceable relative to the intermediate support via a second pivoting guide. The second pivoting guide has a first front pivot lever between the intermediate support and the leg unit.

18 Claims, 10 Drawing Sheets

(56) References Cited

U.S. PATENT DOCUMENTS

| | | | | |
|---|---|---|---|---|
| 3,348,878 | A * | 10/1967 | Rogers, Jr. | 297/68 |
| 5,503,453 | A * | 4/1996 | Saul et al. | 297/89 |
| 6,540,291 | B2 * | 4/2003 | Hoffman et al. | 297/85 R |
| 2006/0220421 | A1 * | 10/2006 | Lai | 297/84 |
| 2008/0018157 | A1 | 1/2008 | Dewert | |
| 2011/0043005 | A1 | 2/2011 | Fischer | |
| 2011/0304193 | A1 | 12/2011 | Murphy et al. | |
| 2012/0248831 | A1 * | 10/2012 | Garland | 297/84 |

FOREIGN PATENT DOCUMENTS

| | | | |
|---|---|---|---|
| DE | 299 00 408 | U1 | 5/1999 |
| DE | 10 2005 001 877 | A1 | 7/2006 |
| DE | 10 2008 009 234 | A1 | 8/2009 |
| WO | WO 2011/015316 | A1 | 2/2011 |

OTHER PUBLICATIONS

Form PCT/ISA/220 Notification of Transmittal of International Search Report issued in International Application No. PCT/EP2014/057495, dated Jun. 18, 2014 (1 page).

Form PCT/ISA/210 International Search Report issued in International Application No. PCT/EP2014/057495 with English translation of categories of documents cited dated Jun. 18, 2014 (5 pages).

Form PCT/ISA/237 Written Opinion of International Searching Authority issued in International Application No. PCT/EP2014/057495 dated Jun. 18, 2014 (4 pages).

* cited by examiner

ITEM OF SEATING FURNITURE AND FITTING THEREFORE

CROSS REFERENCE TO RELATED APPLICATION

This application claims priority from European Application No. 13167391.5, filed May 10, 2013, the disclosure of which is hereby incorporated by reference in its entirety into this application.

FIELD OF THE INVENTION

The invention relates to an item of seating furniture, having a base which is fixed in position during the correct use of the item of seating furniture, a seat unit with a seat surface, and a leg unit which is moveable in relation to the seat unit and has a leg support surface. In this case, the leg unit is displaceable by means of a movement mechanism between a storage position, in which the leg unit is arranged under the seat surface, and a use position, in which the leg unit is arranged in front of the seat surface.

BACKGROUND OF THE INVENTION

Diverse variant embodiments of items of seating furniture of the type in question are known from the prior art.

In order to obtain a sufficiently large leg support surface, there are variant embodiments which have a separately moveable end segment next to the leg unit. Provision is generally made in these configurations for the leg unit to be pivotable in relation to the seat unit, sometimes by means of double bracket mechanisms. The leg unit is then generally adjoined by a pivotable end segment. Examples of documents showing such or similar configurations with a leg segment and end segment include BE 100 91 47 A3, DE 10 2008 009 234 A1 and DE 3718645 C2. In the case of configurations which omit an end segment beyond the leg unit, it is more difficult to realize a sufficiently large leg support surface. For this purpose, DE 10 2005 001 877 A1 proposes a mechanism in which the leg unit is changeable in size. The latter can thereby be reduced in size during the transfer from the use position into the storage position below the seat surface. Only in this way is it possible to ensure a sufficient size of the leg support surface in the use position and a sufficient reduction in size of the leg unit in the pivoted storage position.

SUMMARY OF THE INVENTION

One aspect of the invention is to provide an item of seating furniture of the type in question, which permits the displacement of the leg unit between the storage position and the use position by means of a simple mechanical configuration, wherein it is desired in particular for the item of seating furniture also to be useable in the case of items of seating furniture with less space below the seat unit.

The effect which is in most embodiments intended to be achieved is for an item of seating furniture according to the invention to offer a sufficiently large leg support surface without an end segment which is displaceable in relation to the leg unit having to be arranged next to the latter for this purpose and without the leg unit having to be designed to be changeable in size per se.

According to the invention, this is achieved in that the movement mechanism is designed for transferring the leg unit from the storage position, in which the leg support surface is oriented substantially horizontally, into the use position, in which the leg support surface is likewise oriented substantially horizontally. In order to achieve this, the movement mechanism has an intermediate support which is displaceable in relation to the seat unit or the base by means of a first pivoting guide, wherein the first pivoting guide has at least one first rear pivot lever between the intermediate support and the seat unit or between the intermediate support and the base, respectively. Furthermore, the leg unit is displaceable relative to the intermediate support by means of a second pivoting guide, wherein the second pivoting guide comprises at least a first front pivot lever between the intermediate support and the leg unit.

An item of seating furniture according to one aspect of the invention is an upholstered armchair or an upholstered sofa. In the case of a sofa, the latter may have a plurality of separately moveable leg units.

In conjunction with the detailed description below, the phrase "vertical direction" means a direction orthogonal to a deposition surface on which the item of furniture stands. The phrase "transverse direction" means a direction of extent which extends horizontally parallel to the front edge of the seat surface. The "longitudinal direction" of the furniture is a direction which is orthogonal to the transverse direction and vertical direction of the furniture. The phrases "at the front" and "at the rear" relate to the longitudinal direction of the furniture and refer to the perspective of the person sitting on the item of furniture and whose legs point forwards and whose back points rearwards.

Furthermore, in the context of the description using the phrase "first use state" reference is made to a state of the furniture in which the leg unit is in the storage position thereof. A "second use state" is a state, in which the leg unit is arranged in its use position. In some embodiments of a furniture according to the invention, there is a "third use state" in which, with the leg unit still being extended, the backrest is positioned more flatly in relation to the second use state.

The first use state allows a common seating position with the feet arranged on the ground. The second use state is also referred to as TV-position. With the feet being put up, the second use state still allows an essentially upright seating position. The third use state is intended to be a reclining position.

One important feature of the item of furniture according to the invention is that the latter is designed to displace the leg support substantially horizontally. A powerful pivoting movement, as is generally provided in the case of configurations from the prior art, is avoided. At least in the storage position and in the use position, the leg support has a substantially horizontal orientation, which should be understood as meaning that the leg support surface is in each case not pivoted by more than about 25° in relation to an imaginary horizontal plane. The leg unit is substantially horizontally oriented in this sense during the entire transfer operation from the storage position into the use position. This substantially consistent orientation of the leg unit makes it possible to use a comparatively large leg unit, since the length thereof, unlike in the case of known configurations, does not necessitate a comparative high seat height on the item of seating furniture. The length of the seat support in the longitudinal direction can thus exceed the height of the clearance below the seat unit. As such, it is also possible to dispense with an end segment, which is displaceable separately in relation to the leg unit, for extending the leg support surface.

In order to be able to bring about the movement of the leg unit from the storage position into the use position, a movement mechanism is provided. The movement mechanism has an intermediate support which is provided pivotably on the seat unit or the base by means of the first pivoting guide. The base here is formed by those parts of the item of seating furniture which, during the correct transfer of the leg unit from the use position into the storage position and vice versa, always remain in a fixed position with respect to an underlying surface on which the item of furniture stands. This underlying surface in one embodiment is also a framework on which the feet of the item of furniture are positioned. In this context, "fixed in position" also means a pure rotatability. The base can thus be configured to be rotatable around a vertical axis by means of a rotary plate or a functionally-equivalent unit. A base is also considered to be fixed in position if it allows a luffing movement with respect to an underlying surface.

The seat unit can be moveable in relation to the base in the manner which will be explained below. The moveability of the intermediate support along a circular path, made possible by means of the first pivoting guide, is in an alternative manner in relation to the seat unit or in relation to the base.

The intermediate support itself serves for attaching the leg unit, wherein the second pivoting guide is provided between the intermediate support and the leg unit. The leg unit is therefore displaced in relation to the seat unit, and/or in relation to the base, by two pivoting guides acting in a cumulatively displacing manner. This achieves the desired extent by which the leg unit should be displaced between the storage position thereof and the use position thereof.

The use of two mechanisms in order to jointly achieve the desired displacement distance results in the two mechanisms, which are the first pivoting guide between seat unit or base and intermediate support and the second pivoting guide between the intermediate support and the leg unit, each only having to carry out part of the desired displacement distance. It is therefore possible to use comparatively short levers between the intermediate support, on the one hand, and the base or seat unit, on the other hand. The levers have in some embodiments a length between the coupling points thereof of not more than about 40 cm, and in one embodiment of not more than about 30 cm.

The second pivoting guide which permits the movement of the leg unit in relation to the intermediate support is structured such that the leg unit can be displaced relative to the intermediate support guided by means of the first front pivot lever along a circular path.

Pivoting guides in the sense of the aforementioned first and second pivoting guides are considered to be pivoting mechanisms by means of which the intermediate support is movable relative to the base and/or relative to the seat unit or the leg unit is movable relative to the intermediate support along a circle segment. The circle segment type movability applies in one embodiment to the intermediate support or the leg unit as a whole, in other embodiments only for a pivot axis provided at the end of the pivot lever and assigned to the intermediate support or to the leg unit, which axis is movable along a circle segment shaped path. In one embodiment, for each pivoting guide at least one pivot lever is used, each, which is coupled pivotably on both sides, so that the respective circle segment shaped movability of the intermediate support or of the leg unit in the aforementioned manner does not have to cause a pivoting of the intermediate support or of the leg unit relative to the seat unit/base or the intermediate support as a whole in addition. Rather, it is considered to be advantageous if the orientation of the leg unit relative to the intermediate support and the orientation of the intermediate support relative to the seat unit or the base does not or only insignificantly (less than 25°) change during pivoting.

To that end, in one embodiment the second pivoting guide is configured as double lever pivoting guide. That means that said second pivoting guide is equipped with a first and a second front pivot lever which are attached to the intermediate support pivotable around fifth and sixth pivot axes spaced apart from one another or which are attached to the leg unit pivotable around seventh and eighth pivot axes, so that the leg unit indeed can move along a circular path relative to the intermediate support but per se is not or only slightly pivoted. Besides such a double lever pivoting guide, also other pivoting guides having forced guide arrangement are conceivable.

By means of a configuration having front pivot levers of different length or mutually angled front pivot levers, the extent of tilting during the movement of the leg unit relative to the intermediate support can be controlled. In the case of parallel pivot levers having the same length, the leg support always remains in the same orientation relative to the intermediate support.

In principle, it is conceivable, with regard to the connection of the intermediate support to the seat unit or the base, for the support as a whole to be fixedly connected to the first rear pivot lever, and therefore, with regard to the orientation thereof, to follow the pivoting movement. However, it is advantageous if the first rear pivot lever is coupled to the seat unit or the base so as to be pivotable firstly about a pivot axis and is coupled to the intermediate support so as to be pivotable secondly also about a second pivot axis. This makes it possible to prevent the intermediate support from pivoting to the same extent as is applicable for the pivot lever. The intermediate support can therefore be displaced by the pivoting guide within the context of a substantially consistent horizontal orientation of the leg unit, without substantially having to change its orientation in the process.

In order, nevertheless, to permit a defined displacement of the intermediate support, in one embodiment forced guide arrangements are provided, by means of which each pivoting position of the first pivot lever in relation to the seat unit or in relation to the base is associated with a resultant pivoting position of the intermediate support in relation to the first pivot lever. Forced guide arrangement of this type therefore lead to the desired certainty in the intermediate support movement. Such movement is in one embodiment of a type such that, during the transfer of the leg unit from the storage position into the use position, the intermediate support is not pivoted by more than 20°. A configuration of the forced guide arrangement in the type of a double lever mechanism proved to be particularly advantageous also in this case, as explained above for the connection of the leg unit to the intermediate support. Here, the pivoting guide has a second pivot lever which is coupled to the seat unit or to the base so as to be pivotable about a third pivot axis spaced apart from the first pivot axis, and also is coupled to the pivoting support so as to be pivotable about a fourth pivot axis spaced apart from the second pivot axis, has proven particularly advantageous. By the pivot levers having an identical or substantially identical (+/− about 20%) length between the respective coupling points thereof, the substantially horizontal displacement of the intermediate support is achieved.

The particular feature which arises from the use of the pivoting guide between the base or seat unit, on the one hand, and intermediate support, on the other hand, is the fact that the predominant portion of the intermediate support can always remain below the seat surface. This applies in particular to the coupling points of the first and optionally also the second pivot lever. In one embodiment, the coupling points are arranged in such a manner that they remain completely to the rear of a front edge of the seat surface irrespective of the position of the intermediate support. The effect thus achieved is that the intermediate support moves in relation to the seat surface or the base by means of a pivoting guide which can very readily be concealed from the user's sight. This is advantageous in particular if the abovementioned pivot levers are provided on the outside of the seat surface, with reference to the transverse direction. Mechanical components which extend on the left and right from the seat surface as far as in front of the front edge of the seat surface are considered to be aesthetically disadvantageous and furthermore also form considerable opportunities for injury.

It is accordingly considered to be particularly advantageous if only mechanical components of the second pivoting guide in the region of the leg unit are visible from the outside and from customary perspectives in the use position of the leg unit.

It is in principle conceivable for the two pivoting guides to be mechanically independent such that they can be influenced separately by the user. However, within the context of convenient handling, it is considered to be advantageous if the two pivoting guides are operatively coupled to each other such that, depending on the relative position of the intermediate support in relation to the seat unit or the base, respectively, a relative position, of the leg unit with respect to the intermediate support is set, which is dependent on the first position.

Provision is accordingly in one embodiment made for the movement of the intermediate support in relation to the seat unit or the base along a path in the shape of a section of a circle indirectly also to cause the movement of the leg unit in relation to the intermediate support also along a circle segment path. The corresponding operative coupling is in one embodiment configured such that the respective pivot levers of the first pivoting guide and of the second pivoting guide are moving opposed to one another in order to achieve a great displacement distance of the leg unit.

In one embodiment, a pivot lever of the first pivoting guide and a pivot lever of the second pivoting guide are connected to one another by means of a control rod. The movement of the leg unit relative to the intermediate support should be effected in the same direction as the movement of the intermediate support relative to the seat unit in order to achieve the desired cumulative interaction of the partial movements. In order to achieve that, in one embodiment an extension is provided either at the front pivot lever of the first pivoting guide or at the rear pivot lever of the second pivoting guide, which extension extends beyond the pivot axis of the pivot lever provided at the intermediate support as viewed from the pivot axis of the pivot lever facing away from the intermediate support, wherein the control rod is coupled pivotably to said prolongation. As a result, the desired pivot movement of the pivot levers of the first and of the second pivoting guide in opposing directions can be achieved in a simple manner.

Furthermore, it is considered to be particularly advantageous if the seat unit is designed so as to be displaceable in relation to the base of the item of seating furniture, as has already been explained at the beginning. In this case, the relative movement of the seat unit in relation to the base is in one embodiment operatively coupled to the relative movement of the pivoting support in relation to the seat unit. The user of the item of seating furniture according to the invention can therefore bring about the transfer of the leg unit from the storage position into the use position by displacement of the seat unit in relation to the base. The displacement of the seat unit forwards in relation to the base in one embodiment results in the leg unit being transferred into the use position.

In one configuration, the movement of a backrest unit of the furniture is operationally-coupled to the movement of the seat unit in relation to the base, so that the movement of the seat unit which leads to the transfer of the leg unit into the use position thereof, or a subsequent continued movement of the seat unit, leads to a pivoting of the backrest unit.

In one embodiment, the item of furniture operates in the manner of a pair of scales. Movement of the seat unit downwards brings about a movement of the leg unit upwards. During the transfer of the leg unit between the storage position and the use position, use is therefore made of the potential energy of the unit being lowered in each case and of the body portion resting thereon in order to raise the other unit and the body portion resting thereon. The user, who remains sitting on the item of furniture, therefore only has to supply a small amount of mechanical energy by muscular force or else by an optionally provided motor for the electrical displacement.

It is advantageous if the moveability of the seat unit in relation to the base is provided by two displacement levers which are each coupled on the one side to the base or a displacement unit, respectively, and to the seat unit on the other side about pivot axes spaced apart from each other. The use of two displacement levers having pivot axes which are parallel to each other but are spaced apart from each other provides a structurally very simple possibility for obtaining the displacement of the seat unit in relation to the base or the displacement unit, respectively. The displacement levers are preferably of differing length and/or oriented to be non-parallel, and therefore, during the course of the pivoting movement, the seat unit is also tilted. In one embodiment, in the use position of the leg unit, a front edge of the seat surface is raised. In one embodiment, provision is made for the pivoting angles of the displacement levers between the base and seat unit always to be smaller than the pivoting angles of the pivot levers between the seat unit and intermediate support. In one embodiment, the pivot levers pivot between the storage position of the leg support and the use position of the leg support by more than about 80° while the displacement levers pivot through less than about 60°.

In order to obtain a stable use position and/or a stable storage position of the leg unit, the following measures are expedient: if the leg unit is in the storage position thereof below the seat unit, at least one of the displacement levers or pivot levers is in one embodiment close to a dead center position or even in a position beyond the dead center such that, in order to transfer the leg unit into the use position, initially a slight raising of the seat unit at least in the region of the displacement lever in the position beyond the dead center is required. As an alternative or in addition, an activating lever can be provided, the activating lever making it possible to leave the dead center position by means of a manually applied muscular force.

The above avoids the leg unit being inadvertently transferred into the use position. In one embodiment, when the leg unit is in the use position thereof, at least one of the displacement levers, and in one embodiment both displacement levers, is or are in a position in which an angle between a connecting straight line, which connects the coupling points of said displacement lever, on the one hand, and a horizontal plane, on the other hand, is in one embodiment less than about 60°, in particular less than about 50°. A shifting of the leg unit from the use position in the direction of the storage position thus requires a comparatively powerful application of force to the leg unit, the application customarily not being brought about inadvertently.

One advantageous embodiment of the item of seating furniture according to the invention includes the base and the seat unit being attached to one another by means of a displacement unit, the displacement unit being moveable in relation to the base and the seat unit being moveable in relation to the displacement unit.

The displacement unit serves the purpose of ensuring an additional displacement of the seat unit. Thus, the latter can not be displaced in a guided manner in relation to the base directly, but in relation to the displacement unit, which in turn can be displaced in relation to the base per se. As a result, the seat unit can be displaced in total very far between the two extreme positions thereof, which is in particular convenient in order to allow pivoting of the backrest of the item of furniture far down backwards, without interference.

In this case, it is of particular advantage when the displacement unit can be displaced forwards relative to the base along a movement path starting from a base position, the movement path in one embodiment being linear or almost linear. In this case, the linear movement can be achieved in one embodiment via a slotted guide system or a lever system.

An almost linear movement refers to a movement which between the starting position and the end position thereof has a deviation from a theoretical straight line orthogonal to the straight line that is at maximum of about 20% of the distance between the starting position and the end position.

The displacement of the displacement unit in relation to the base is in one embodiment between about 13 cm and about 15 cm.

With regard to the movement path of the displacement unit, it is furthermore considered to be advantageous if the movement path has a slope to the front thereof. Thereby, a permanent force application of the displacement unit back into the base position thereof is achieved. If the displacement unit is displaced forwards along the movement path when transferring the item of furniture into the third use state thereof, the energy involved therefore is partially stored as potential energy. During the re-transfer into the second use state, the energy is available for supporting the transfer.

The aforementioned lever system for displacing the displacement unit in relation to the base in one embodiment is configured in such a way that it includes at least one movement lever, which is coupled to the displacement unit so as to be pivotable and which on its part is guided by means of at least two intermediate levers which are coupled to the base so as to be pivotable.

By means of such a lever system, despite the natural pivotability of such levers, an almost linear movement can be achieved. In particular, this is obtained by at least one of the movement levers being coupled to the base by means of a first and a second intermediate lever, with the following three distances being at least almost identical. Firstly, this is the distance between the pivot axis around which the first pivot lever is coupled to the movement lever and a pivot axis around which the movement lever is attached to the displacement unit so as to be pivotable. Furthermore, secondly, this is the distance between the aforementioned pivot axis around which the first intermediate lever is coupled to the movement lever and a pivot axis around which the movement lever is attached to the second intermediate lever so as to be pivotable. And, thirdly, this is the distance between the aforementioned pivot axis around which the first intermediate lever is coupled to the movement lever, and a pivot axis around which the first intermediate lever is attached to the base so as to be pivotable.

The three distances mentioned above together define the movement path along which the pivot axis of the movement lever and the displacement unit can be moved in relation to the base. By means of a deviation from one another by a maximum of about 20% (shortest distance in relation to longest distance), the desired almost linear movement is made possible.

In one embodiment, the backrest unit can be pivoted around a backrest axis in relation to the seat unit, the backrest axis being displaceable together with the seat unit in relation to the base. In this case, in a further embodiment, a backrest guidance system is provided by means of which the backrest unit can be pivoted around the backrest axis depending on the relative position of the seat unit to the base and/or the relative position of the displacement unit to the base. The backrest guidance system leads to a predefined pivotability of the backrest. The position of the latter is defined by the pivot axis on the side of the seat unit, on the one hand. On the other hand, the backrest guidance system defines how far the backrest lowers if said pivot axis is displaced.

In one possible embodiment of such a backrest guidance system, the guidance of the backrest is effected by means of a slotted guide track and a roller or a slider inserted therein. In a preferable configuration, in this case the slotted guide track is provided on the base fixed in position, while the roller or the slider is attached to the back unit.

Also possible is a configuration in which the backrest guidance system includes a control lever which is attached to the backrest unit eccentrically to the backrest axis which forms an operative coupling to the other movable parts of the furniture. In particular, the control lever can be attached to the backrest unit so as to be pivotable on the one side and on the other side be attached to the base or to one of the movement levers of the displacement unit so as to be pivotable.

In order to facilitate the use of the item of furniture, in one embodiment at least one of a first and a second blocking system are provided, the first blocking system being configured to block a displacement of the displacement unit in relation to the base in the storage state of the leg unit, and the second blocking system being configured to block a displacement of the leg unit in relation to the seat unit in the third use state. As a result, when realizing both blocking systems, the user on the one hand is prevented from bringing the backrest into a reclining position without bringing the leg unit into the use position beforehand, and on the other hand, when starting from the reclining position, the user is prevented from displacing the leg unit in the direction of its storage position without first bringing the backrest back in the direction of its upright position.

In one embodiment, this is achieved by the first and/or the second blocking system defining a maximum distance or a minimum distance between two points, one of which is displaced together with the backrest unit and the other of which is displaced together with the leg unit. A particularly advantageous system is one in which both blocking systems are commonly formed by two stops which bear against one another in both the first and the third use state, and thus cause the desired blocking effect. Particularly advantageous is the use of a bracket provided on the backrest so as to be pivotable, the backrest having a slot hole whose one end forms one of the stops, while the other stop is formed by a bolt in the slot hole.

It is furthermore considered to be advantageous if a spring device is provided on the item of seating furniture, the spring device in each case putting up a counterforce to a transfer of the leg unit from the use position in the direction of the storage position and/or to a transfer of the leg unit from the storage position in the direction of the use position. This increases the stability of the storage position and of the use position.

In order to obtain the effect of the use position and storage position being stabilized, it is advantageous if the spring device is arranged on subcomponents of the item of seating furniture between coupling points, wherein the coupling points are arranged in such a manner that, during the transfer of the leg support from the storage position into the use position, said coupling points are first of all spaced apart from each other and subsequently are drawn nearer to each other.

Therefore, the leaving both of the use position and the storage position requires the supply of mechanical energy to the spring device.

The invention furthermore relates to a fitting system for items of seating furniture, the fitting system being designed in such a manner that it provides the abovementioned relative movement between a seat unit, on the one hand, and a constructional unit, on the other hand.

DETAILED DESCRIPTION

Figure 1A:
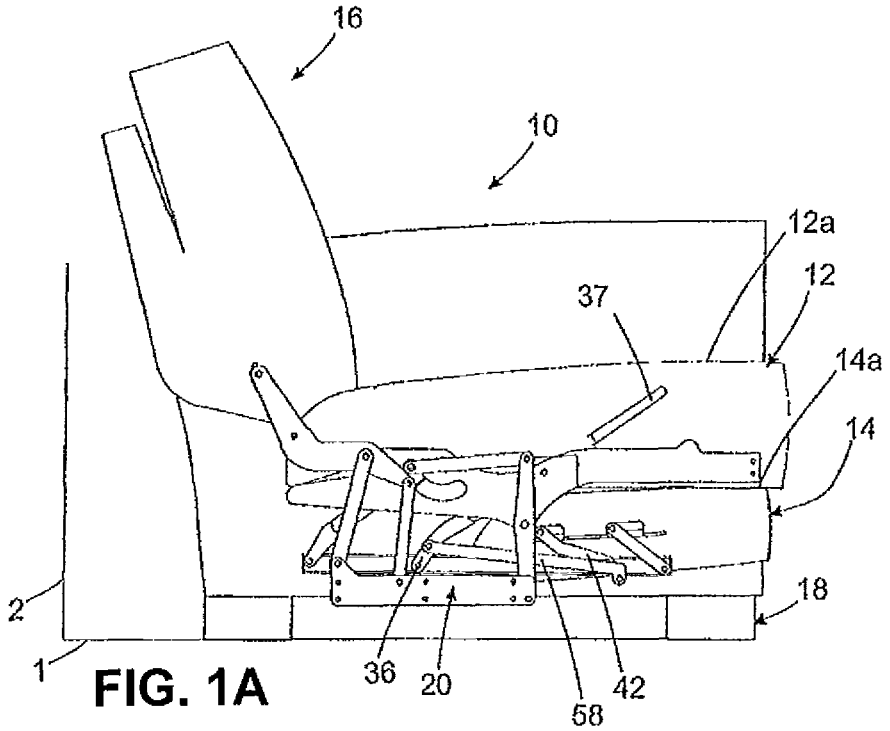
FIGS. 1A to 3B show a first embodiment of an item of seating furniture according to the invention in different use states.

FIG. 1A shows an item of seating furniture 10 according to the invention, which for illustrative purposes is designed as an upholstered armchair.

The item of seating furniture 10 has three units which are moveable in relation to one another and are each upholstered, namely a seat unit 12, a leg unit 14 and a backrest unit 16.

The item of seating furniture 10 furthermore has a base framework 18 which forms the base of the item of seating furniture. The base framework 18 is arranged in a fixed position with respect to a floor and a wall 2 located to the rear of the item of seating furniture 10. The item of seating furniture 10 has a movement mechanism 20 which is embodied by the furniture fitting 22 illustrated in FIG. 1B and which serves the purpose of ensuring the relative movement of the seat unit 12 and of the leg unit 14 from the storage position of FIGS. 1A, 1B into the use position of FIGS. 3A, 3B.

The main components of said furniture fitting 22 are explained below with reference to FIG. 1B. The furniture fitting 22 has two attachment strips 24 which are fixedly connected to the base framework 18. The furniture fitting 22 furthermore has a frame 26 which serves in a manner not illustrated specifically for the attachment of the seat unit 12 and which is therefore always moved jointly with the seat unit 12. Furthermore, for the attachment of the leg unit 14, the fitting 22 has a support 28 which always remains in a fixed position with respect to the leg unit 14.

These components are connected to one another as explained below. A number of subsequently mentioned parts of the fitting 22 are in each case provided on the left and right sides of the seat surface and designed for the corresponding movement. Only one of the components is in each case referred to here.

Two displacement levers 32, 34 are provided between the base-mounted attachment strips 24 and the seat-unit-mounted frame 26, the displacement levers each being pivotable about a base-side pivot axis 32*a*, 34*a* extending in the furniture transverse direction and each being pivotable about a frame-mounted pivot axis 32*b*, 34*b* extending in the furniture transverse direction. With this arrangement, the basic movability of the seat unit 12 in relation to the base framework 18 is provided, wherein, by means of the lever lengths which slightly differ from one another and/or the orientation of the levers in the storage position of FIG. 1A, a tilting movement of the seat unit 12 in relation to the base framework 18 is also forced during the course of the movement of the seat unit.

Two pivot levers 36, 38 are provided between the frame 26 and an intermediate support 30 arranged below the frame, wherein the pivot levers are pivotable about pivot axes 36*c*, 38*c* provided in a fixed position with respect to each other on the intermediate support 30 and about pivot axes 36*b*, 38*b* provided in a fixed position on the frame 26. Forced guidance is therefore also provided between the frame 26 and the intermediate support 30. The intermediate support 30 is moveable in relation to the frame 26 due to the forced guidance only along a movement path predetermined by the pivot levers 36, 38. Since the levers have approximately the same distance between their respective pivot axes, the movement takes place with only a slight tilting of the intermediate support 30 in relation to the frame 26.

The relative movement of the frame 26 in relation to the base framework 18 and the relative movement of the intermediate support 30 in relation to the frame 26 are operatively coupled to each other. For this purpose, a coupling lever 40 is provided, the coupling lever 40 being coupled pivotably at one end to an elongation of the displacement lever 32 and at the other end to the pivot lever 38. The result is that the movement of the seat unit 12 in relation to the base framework 18 also forces a movement of the intermediate support 30 in relation to the frame 26. This is also explained below.

The intermediate support 30 is substantially formed by a hollow tube extending in the direction of a furniture longitudinal axis 4.

At the front end of the intermediate support 30, the aforementioned support 28 of the leg unit 14 is attached. The attachment is again effected by means of two front pivot levers 42, 44 which each are attached to the intermediate support 30 pivotably around fifth and sixth pivot axes 42*a*, 44*a* on the one hand and which on the other hand are attached to the support 28 pivotably around seventh and eighth pivot axes 42*b*, 44*b*. This results in a forced guide similar to the connection of the frame 26 to the base 18 and similar to the connection of the intermediate support 30 to the frame 26. The movement path of the support 28 relative to the intermediate support 30 is thus defined by means of the two pivot levers 42, 44. The pivot levers 42, 44 have lengths slightly differing from one another between their respective pivot axes so that the movement of the support and of the leg unit 14 relative to the intermediate support 30 involves a defined, slight inclination of the leg unit relative to the intermediate support.

In order to cause the displacement of the support 28 relative to the intermediate support 30, a transmission lever 58 is provided. On the one hand, the transmission lever 58 is coupled pivotably to the rear pivot lever 36 and on the other hand coupled pivotably to the front pivot lever 42. In this case, the transmission lever is coupled on the side of the rear pivot lever 36 between the two pivot axes 36*b*, 36*c* thereof, while it is coupled to the front pivot lever 42 beyond the intermediate support sided pivot axis 42*a* as viewed from the support sided pivot axis 42*b*. The type of arrangement ensures that the pivot movement of the rear pivot levers 36, 38 relative to the pivot movement of the front pivot levers 42, 44 is in opposed directions. If, with reference to the side view of FIG. 1A, the pivot lever 36 is pivoted forwards counter clockwise for displacing the intermediate support 30, this causes a pivoting of the pivot lever 42 in clockwise direction by means of the transmission lever 58.

A movement mechanism which includes a complete operative coupling between all of the components thereof is therefore provided. The arrangement of all of the other components of the furniture fitting 22 is determined by the relative position of the seat unit 12 in relation to the base framework 18, which relative position is influenced by the user.

Figure 1B:
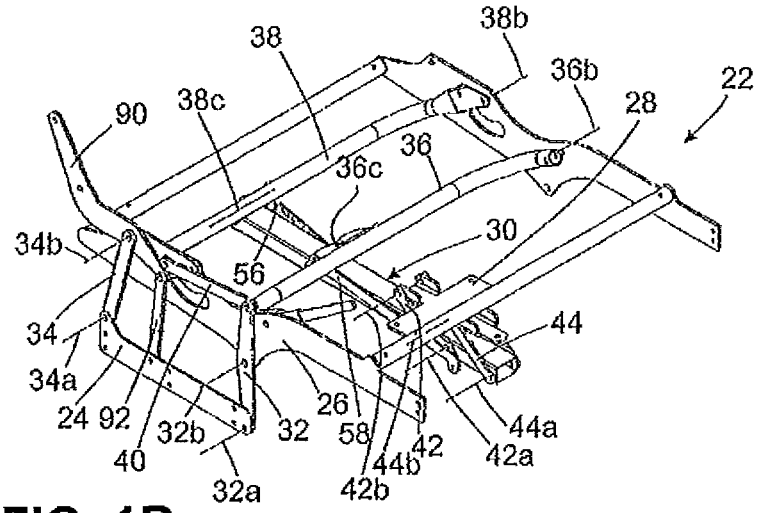

In the case of the item of furniture of FIGS. 1A and 1B, the backrest 16 is attached to a backrest support 90. The backrest support 90 can be pivoted in relation to the seat unit 12 and the frame 26 thereof. In this and in the following embodiments, the respective pivot axis corresponds to the pivot axis 34*b*, but could also be formed by means of a separate pivot axis spaced apart therefrom.

In order to achieve an operative coupling between the relative movement of the seat unit 12 in relation to the base 18, the backrest support 90 is still pivotably coupled to a control lever 92, which on the other end thereof is pivotably attached to the attachment strip 24 on the base side. Since the transfer lever 34 and the control lever 92 have an orientation deviating from one another, they cause a pivot movement of the backrest support 90 in relation to the base, if the transfer lever 34 is pivoted forwards in relation to the base in the course of a transfer of the seat unit 12. With the extension of the leg support, the backrest is thus also slightly pivoted backwards.

To sum up, the embodiment of FIGS. 1A to 3B thus includes the following, operatively-coupled partial components. In relation to the seat unit 12 and the frame 26 thereof, starting from the first use position of FIG. 1A the intermediate support 30 can be pivoted forwards, wherein by means of the transmission lever simultaneously a pivoting of the sliding member 46 forwards in relation to the intermediate support 30 is caused. The displacement forwards of the intermediate support 30 and of the support 28 is effected by means of a force application to the seat unit 12 by the person sitting thereon and/or by means of a simultaneous operation of an operation lever 37. Thereby, the seat unit 12 together with the frame 26 can be displaced forwards in relation to the base. The movement is coupled to the pivot movement of the intermediate support 30 in a compelled manner via the coupling lever 40. The movement forwards of the seat unit 12 and of the frame 26 furthermore also causes a pivoting of the backrest 16 into a slightly more flat and comfortable position.

In the starting state of FIGS. 1A and 1B, in which the leg unit 14 is located below the seat unit 12, the item of furniture has the function and appearance of a simple armchair. In this state, the displacement lever 34 extends substantially vertically such that a rear end of the seat surface 12*a* takes up the highest conceivable position thereof. In order to displace the leg unit 14, starting from FIG. 1A, the displacement levers 32, 34 have to be pivoted in the clockwise direction with reference to the perspective of FIG. 1A. The stability of the starting position is reinforced by a spring 56, which is coupled to the pivot levers 36, 38 and which would be extended if the seat unit 12 were displaced in relation to the base framework 18.

Figure 3A:
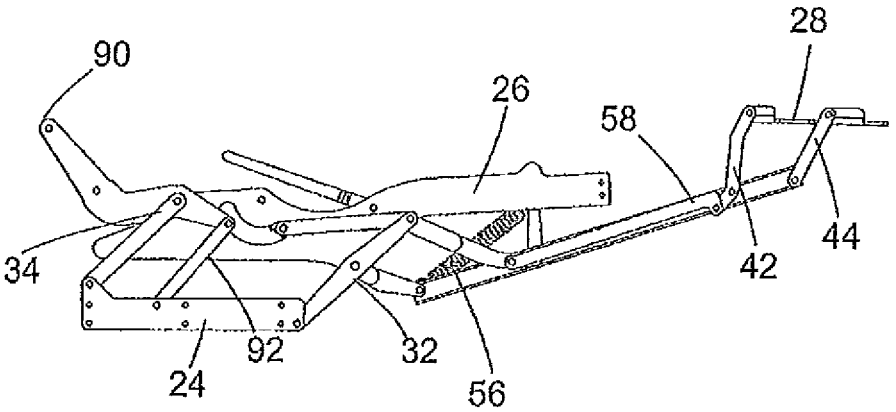
Figure 3B:
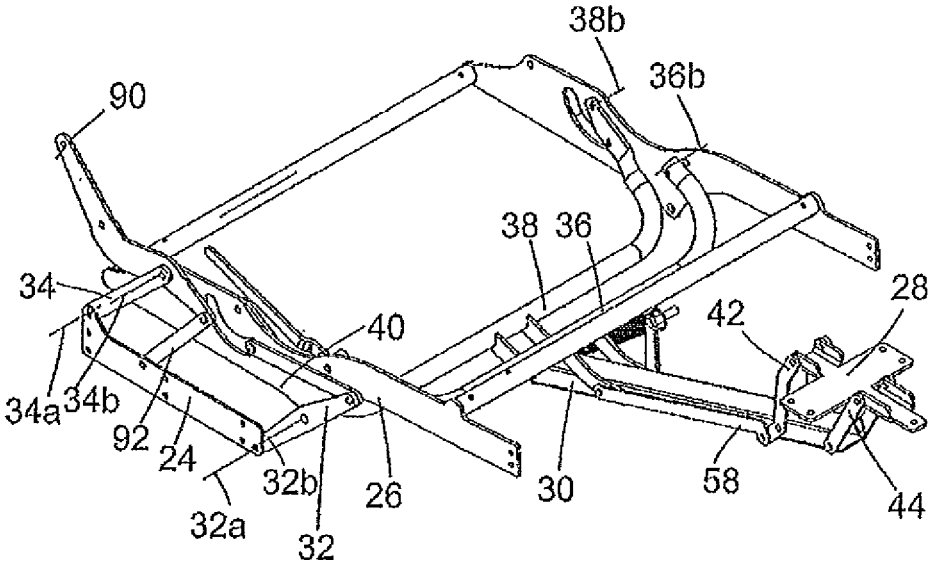

In order to obtain a transfer of the item of seating furniture 10 into the state of FIGS. 3A, 3B, the user has to effect a forwards displacement of the intermediate support 30. In one embodiment, the user does this by being supported, for example, on the back unit 16 and thereby displacing the seat unit 12 forwards. A similar action can also be obtained by an actuation lever 37 which, upon actuation, permits the movement and produces an initial push for the transfer.

Figure 2A:
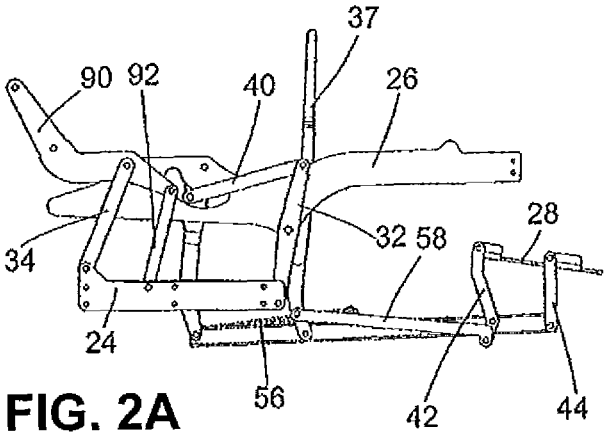

The resultant intermediate state is illustrated in FIG. 2A. By means of the coupling of the front displacement lever 32 to the rear pivot lever 38 via the control lever 40, the displacement of the seat unit 12 leads at the same time to a displacement of the leg unit 14 in relation to the seat unit 12. The latter is shifted forwards in a manner substantially free from pivoting and guided primarily by the pivot levers 36, 38. However, the displacement of the leg unit is not restricted to an extent effected by the pivot levers 36, 38 and by which the intermediate support 30 is displaced. Instead, owing to the operative coupling of the support 28 and the front pivot levers 42 thereof with the intermediate support 30 and the rear pivot lever 36 thereof via the transmission lever 58, an additional displacement of the support 28 is also obtained. Thus, the displacement of the leg unit 14 relative to the seat unit 12 is composed of the pivot displacements of the intermediate support 30 relative to the frame 26 and of the support 28 relative to the intermediate support 30.

As the movement continues, the state shown in FIGS. 3A to 3B is achieved. By means of the circular path on which the intermediate support 30 is moved, the leg unit 14 is raised in relation to the seat unit 12 towards the end of the relative movement such that, towards the end of the movement, the leg support surface 14*a* is arranged on the surface of the leg unit 14 approximately level with the seat surface 12*a*.

The displacement of the seat unit 12 from the starting state of FIGS. 1A, 1B into the position of FIGS. 3*a*, 3*b* makes it possible for the backrest unit 16 displaced forwards together with the seat unit 12 to pivot in the illustrated manner into a comfort position without, in the process, entering into touching contact with the wall 2. This is obtained by the displacement of the seat unit 12.

In the case of the second embodiment illustrated in FIGS. 4A to 6B, the seat unit 12 together with the frame 26 on the seat unit side as well as together with all mechanical components of the intermediate support 30, the sliding member 46 and of the leg unit 14 are identically configured with respect to the embodiment of FIGS. 1A to 3B, so that reference is made to the description given there.

The particular feature of the embodiment of the FIGS. 4A to 6B as well as of the embodiment of the FIGS. 7 to 10B subsequently described is that the respective item of furniture cannot only be used in the manner already described between a first use position with the leg unit 14 under the seat unit 12 and a second use position with the leg unit 14 in front of the seat unit 12, but that it also includes a third use position, in which, with the leg unit 14 extended, the backrest 16 is significantly lowered so that comfortable resting on the item of furniture is made possible.

In this case, it is desired that the backrest 16 in the third use position, despite the orientation of said backrest suitable for reclining, is not further displaced backwards or is only slightly further displaced backwards in the third use position in relation to the first use position, so that the item of furniture in the first use position can be arranged flush with a wall and nevertheless allows the transfer into the third use position and the resting accommodation offered thereby without the movement of the backrest 16 being encumbered by the wall.

For this purpose, in the present second as well as in the subsequent third embodiment, provision is made such that the displacement of the seat unit is not limited to the dimension offered by means of the displacement levers 32, 34. In addition, a displacement unit 80 is provided, which functionally is arranged between the base 18 and the seat unit 12 together with the frame 26 and which on its part can also be displaced forwards.

Figure 4A:
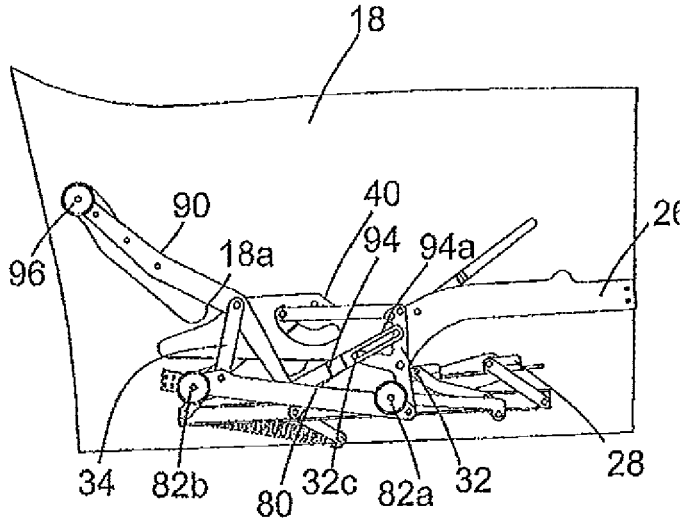
FIGS. 4A to 6B show a second embodiment of an item of seating furniture according to the invention in different use states.
Figure 4B:
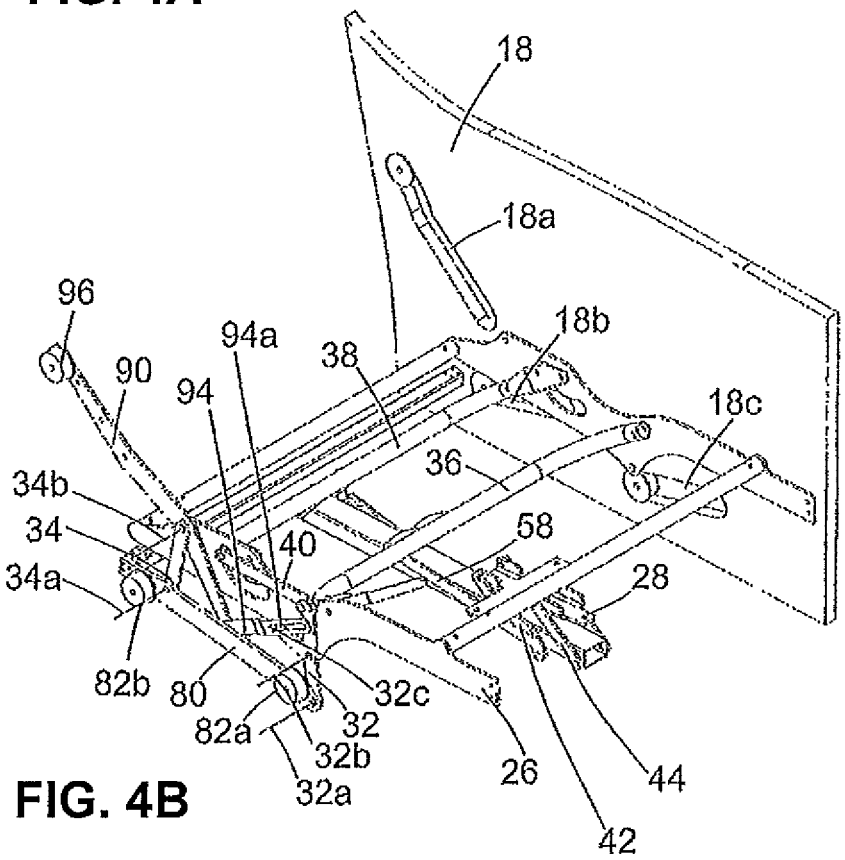

It can well be seen from FIG. 4B that the displacement unit 80 replaces the attachment strip 24 on the base side of the first two embodiments with regard to the attachment of the displacement levers 32, 34. The seat unit 12 together with the frame 26 and indirectly the intermediate support 30 as well as the support 28 can be moved in relation to the displacement unit 80 in the same way as they can be moved in the embodiment of FIGS. 4A to 6B in relation to the base and the attachment strip 24 thereof.

However, the displacement unit 80 itself can additionally be moved in relation to the base in the case of the embodiment of FIGS. 4A to 6B. As a result, a further increased movability of the seat unit 12 in relation to the base is achieved. The relative movability of the displacement unit 80 in relation to the base 18 is achieved by means of two slotted guide tracks 18*b*, 18*c*, which are provided in side surfaces of the base 18, and in which in each case one guide roller 82*a*, 82*b* is inserted, which guide rollers 82*a*, 82*b* are rotatably supported on the displacement unit 80. The slotted guide tracks 18*b*, 18*c* are slightly inclined with a forward rising slope.

Since in the embodiment of FIGS. 4A to 6B the resting accommodation is considered to be provided as a third use state of the item of seating furniture, the coupling of the backrest support 90 to the other components of the item of seating furniture is realized in a way different from the configuration of the embodiment of FIGS. 1A to 3B.

There are further slotted guide tracks 18*a* on both sides for the backrest support 90 which are also provided in side surfaces of the base 18. The technical purpose of this configuration will subsequently be explained.

Figure 8A:
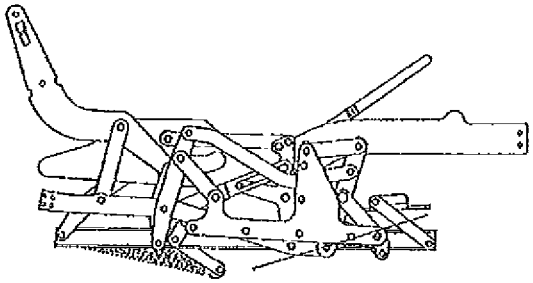
Figure 8B:
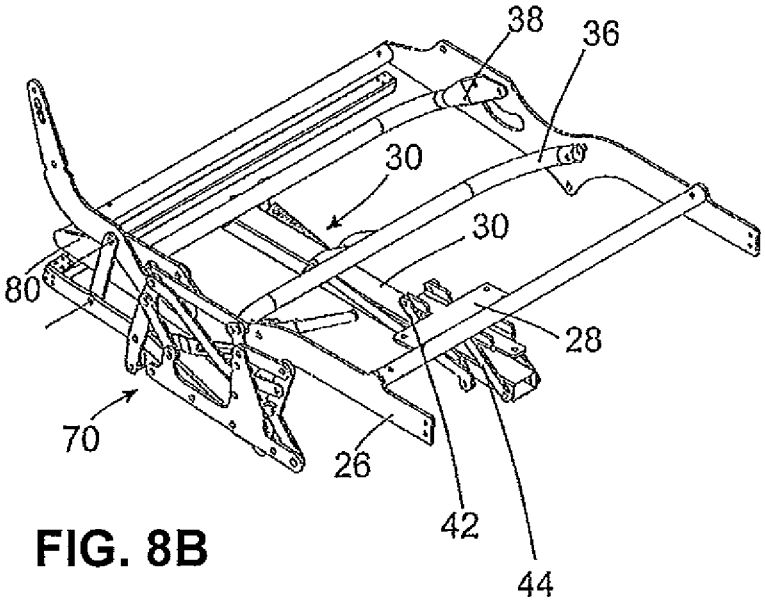

As can be seen from the transfer from the first use state of FIGS. 4A and 4B into the second use state of FIGS. 8A and 8B, the position of the guide rollers 82*a*, 82*b* in the slotted guide tracks 18*b*, 18*c* initially remains unchanged during the transfer. Instead, the movement of the leg unit and of the intermediate support 30 during the transfer is effected in the same way as in the case of the embodiment of FIGS. 1A to 3B.

Figure 5A:
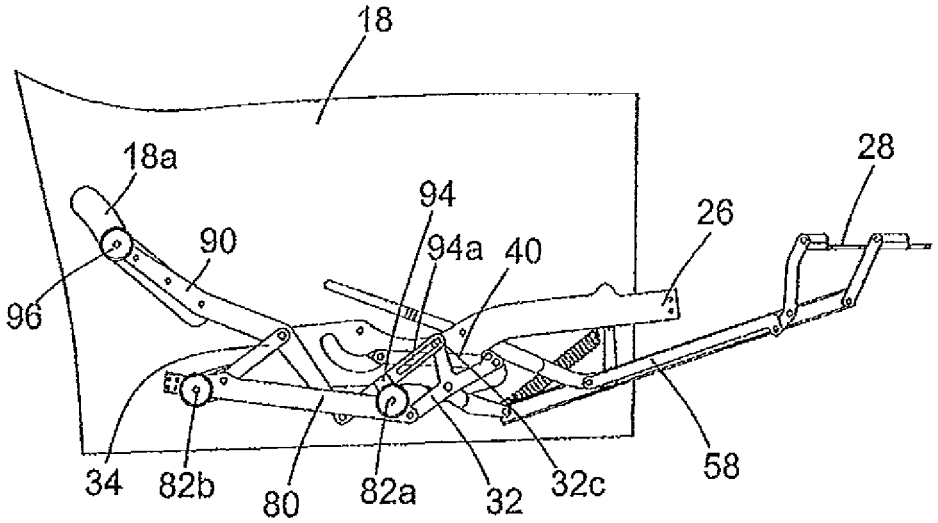
Figure 5B:
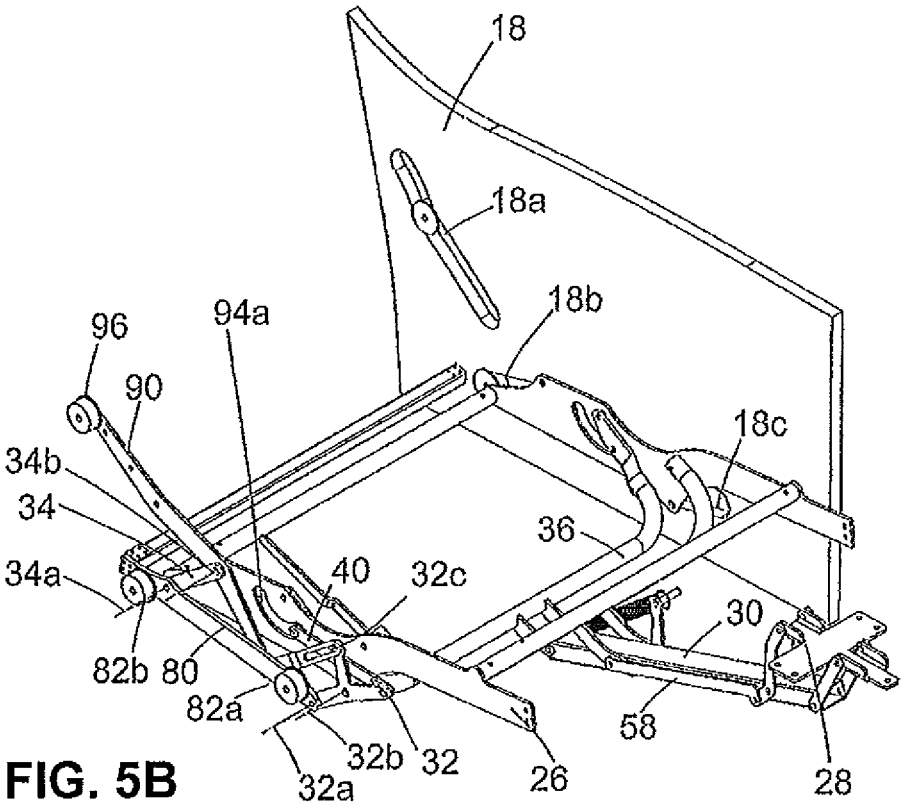

The unchanged position of the guide rollers 82*a*, 82*b* during the transfer from the initial position into the second use state of FIGS. 5A, 5B on the one hand is subject to the inclined orientation of the slotted guide tracks 18*b*, 18*c*. However, an intentional or unintentional displacement of the displacement unit 80 during the first transfer phase into the second use state is also prevented by pivotably attaching a bracket 94 to the backrest support 90, in which a slot hole 94*a* is provided. A bolt 32*c* extends into the slot hole 94*a*, which bolt 32*c* is provided at the front displacement lever 32 and which bears against a stop region limiting the slot hole 94*a* on the end side thereof in the first use state of FIGS. 4A and 4B. The bolt 32*c* and the slot hole 94*a* thereby prevent an immediate lowering of the backrest in the first use state of FIGS. 4A, 4B.

Thus, the backrest is lowered only to a minor extent during the transfer from the first use state of FIGS. 4A, 4B into the second use state of FIGS. 5A, 5B. The minor extent is predefined by means of the shape of an upper section of the slotted guide track 18*a*. When the seat unit 12 together with the frame 26 is displaced forwards during the transfer into the second use state, likewise the pivot axis 34*b* of the backrest 16 is displaced forwards and the backrest 16 guided by the rollers 96 in the slotted guide tracks 18*a* is slightly pivoted. In principle, by means of another shape of the slotted guide tracks 18*a* in the upper partial section thereof, a configuration would be possible where the transfer from the first into the second use state does not yet cause any pivoting movement of the backrest 16.

Figure 2B:
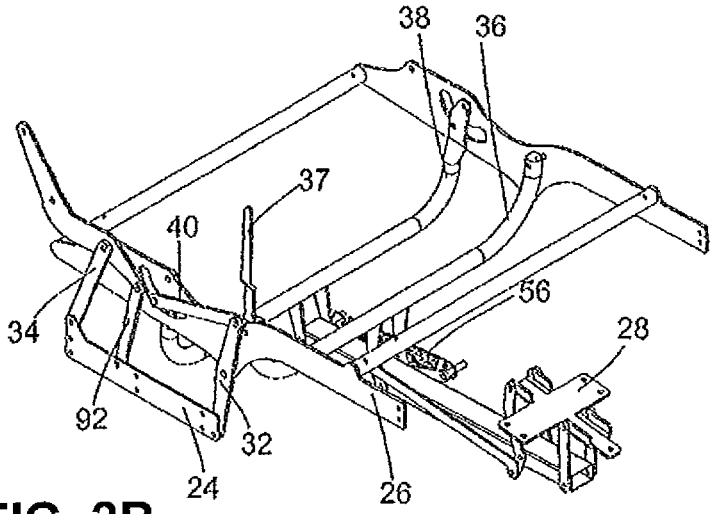

As soon as the second use state of FIGS. 5A, 5B is reached, the displacement levers 32, 34 are pivoted forwards according to the second use state of FIGS. 2A, 2B of the preceding embodiment. Hereby, also the bolt 32*c* on the front displacement lever 32 in the slot hole 94*a* of the corresponding bracket 94 is now arranged on the opposite end of the hole 94*a*.

Figure 6A:
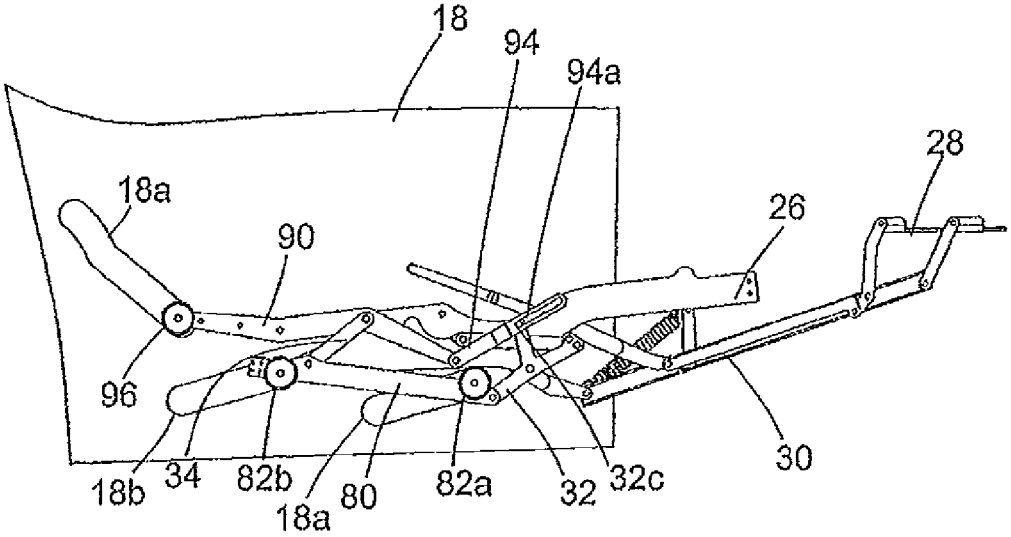
Figure 6B:
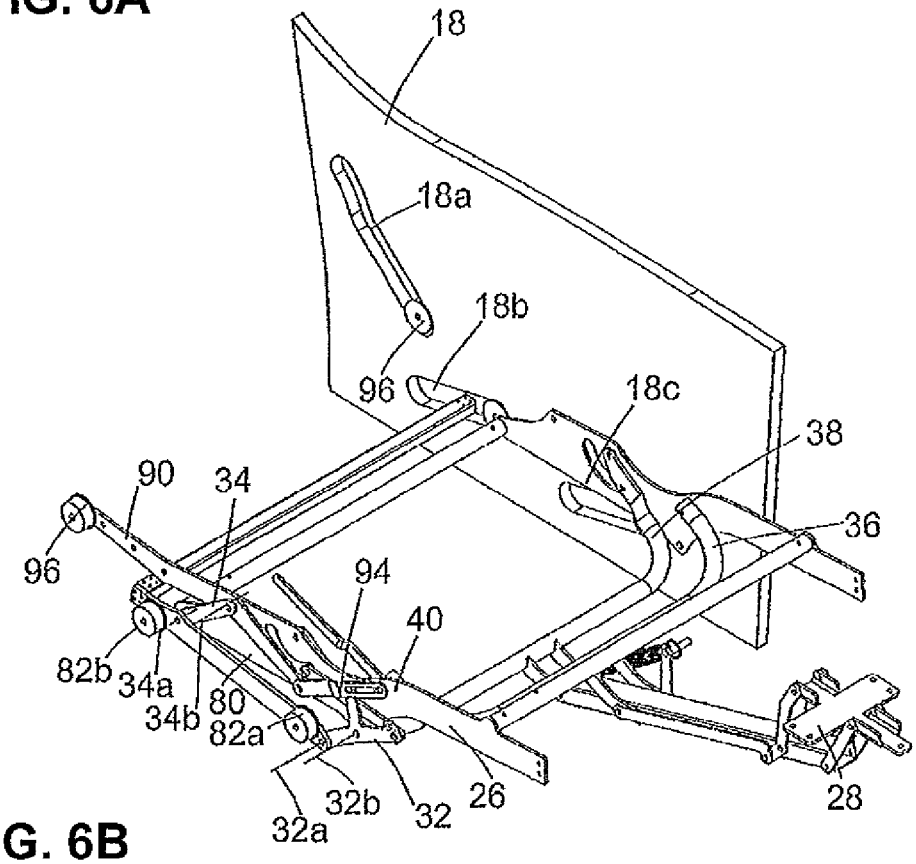

Thus, starting from the second use state, the item of furniture can then be transferred into the third use state of FIGS. 6A, 6B, where the backrest 16 is pivoted downwards significantly further. The transfer into the third use state is initiated by the sitting person pressing his or her back against the backrest 16 and/or pressing the seat unit 12 forwards. Thereby, the backrest rollers 96 in the slotted guide tracks 18*a* are pressed downwards beyond the position of FIGS. 5A, 5B. The effect thereof is an independent forced displacement forwards of the displacement unit 80 together with the seat unit 12 and the extended leg unit 14 in relation to the base, wherein this is effected by a forward rolling of the slotted guide rollers 82*a*, 82*b* in the slotted guide tracks 18*b*, 18*c*. Besides the forward displacement, this also leads to a slight upward displacement of the displacement unit 80 and of the seat unit 12 due to the orientation of the slotted guide tracks 18*b*, 18*c*.

As can be seen from comparing FIGS. 5A, 5B on the one side and FIGS. 6A, 6B on the other side, all mechanical components influencing the relative movement of the seat unit 12 in relation to the displacement unit 80 and the relative movement of the intermediate support 30 as well as the support 28 in relation to the seat unit 12 remain in an unchanged position in relation to one another in the third use state of FIGS. 5A, 5B. All of the components are displaced merely in the entirety thereof forwards or slightly upwards. During the transfer into the third use state, only the backrest support 90 and the brackets 94 pivotably coupled thereto with the slot holes 94*a* are moved in relation to the components.

In the third use state of FIGS. 6A, 6B, comfortable resting is possible on the item of furniture with a far-pivoted backrest 16 and extended leg unit 14.

During the re-transfer, it is desired that initially only the backrest is returned into a closer to vertical position again without displacement of the leg unit in the direction of its storage position in relation to the seat unit 12 at this early stage. The stop region or end of the slot hole 94*a* serves this purpose as well. As can be seen from FIGS. 6A, 6B, also in the third use state the bolt 32*c* is again arranged at the end limit of the slot hole 94*a*. A direct pivoting of the leg unit 14 which would indirectly also involve pivoting of the pivot lever 32, is therefore initially impossible. Not until the backrest support 90 is pivoted back in the direction of its upright position will the slot hole 94*a* be displaced and then allow a movement of the leg unit 14. The re-transfer from the third use state into the second use state is facilitated by the weight of the sitting person which presses the slotted guide rollers 82*a*, 82*b* in the slotted guide tracks 18*b*, 18*c* in the direction of the initial position thereof.

The embodiment of FIGS. 7 to 10B is functionally very similar to the embodiment of FIGS. 4A to 6B. The item of seating furniture with the fitting thereof shown in FIGS. 7 to 10B is also provided for use in a first, second and third use state, wherein again in the first use state the backrest 16 is upright and the leg unit 14 is retracted, in the second use state the leg unit 14 is extended, and in the third use state with extended leg unit 14, the backrest 16 is significantly pivoted in order to achieve a reclined position.

Unlike the configuration of FIGS. 7 to 10B, however, slotted guide tracks 18*a*, 18*b*, 18*c* are dispensed with for that. Instead, an additional lever system 70 is provided, which replaces the function of the slotted guide tracks of the preceding embodiment.

Figure 7:
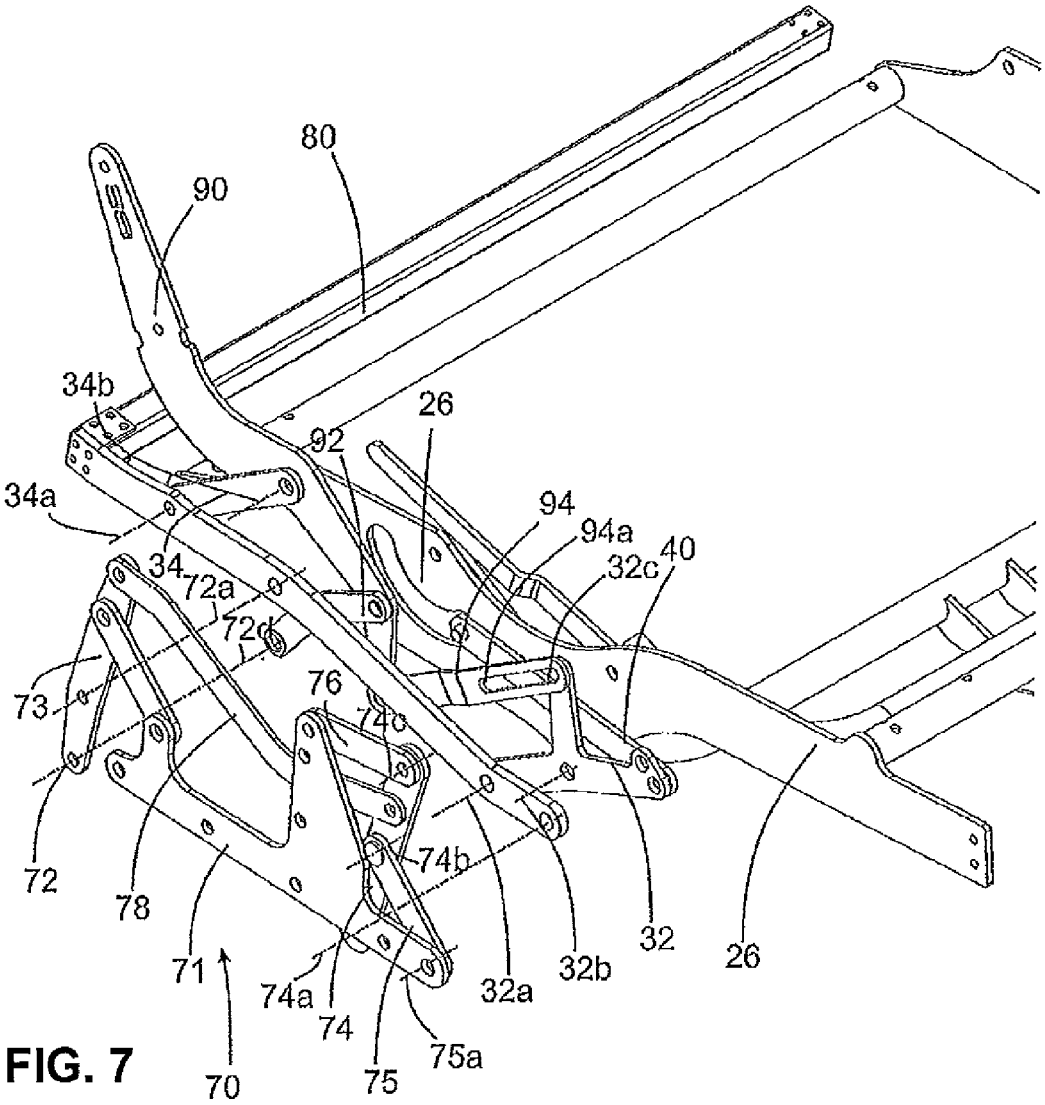
FIGS. 7 to 10B show a third embodiment of an item of seating furniture according to the invention in different use states.

FIG. 7 shows an exploded view in which the lever system 70 has been removed from the displacement unit 80 for explanatory purposes. To begin with, this illustration reveals that the entire assembly group is functionally almost identical to the configuration of FIGS. 4A to 6B, wherein the assembly group comprises the displacement unit 80, the seat unit 12 with the frame 26, which seat unit 12 is pivotably supported on the displacement unit 80 by means of the displacement levers 32, 34, and the intermediate support 30 pivotably supported on the frame 26 with the support 28 displaceable in relation thereon, The only functionally important differences are the omission of the guide rollers 82*a*, 82*b* as well as the presence of an additional control lever 92 for connection of the backrest support 92, which function will subsequently be explained.

The additional lever system 70 includes an attachment strip 71 fixedly attached to the base, in relation to which two movement levers 72, 74 can be displaced. The movement levers 72, 74 are in each case not directly pivotably attached to the attachment strip 71 but by means of further intermediate levers which will subsequently be explained. In turn, the two movement levers 72, 74 include holes defining pivot axes 72*a*, 74*a*, in the region of which the displacement unit 80 is pivotably attached to the movement levers 72, 74.

The intermediate levers by means of which the movement levers 72, 74 are moveable in relation to the attachment strip 71 in a defined manner serve the purpose of ensuring a movability of the displacement unit 80 in relation to the attachment strips approximately corresponding to the movability provided by the slotted guide tracks 18*b*, 18*c* in the exemplary embodiment of the FIGS. 4A to 6B. In this case, the intermediate levers ensure an approximately linear movability.

This is explained using the example of the front movement lever 74. The movement lever 74 is attached to the attachment strip by means of two pivotable intermediate levers 75, 76. In this case, the lower intermediate lever 75 is of particular importance. The lever 75 is adjusted to the movement lever 74 in such a way that the distance between the pivot axis 74*a*, in the region of which the displacement unit 80 is attached to the movement lever 74, and the pivot axis 74*b*, around which the intermediate lever 75 is pivotably attached to the movement lever 74, essentially corresponds to the distance between the pivot axis 74*b* and the pivot axis 75*a* around which the intermediate lever 75 is pivotably coupled to the attachment strip 71. At the same time, the distance between the pivot axis 74*b* and the coupling axis 74*c* around which the intermediate lever 76 is coupled to the movement lever 74 also corresponds approximately to this distance.

Figure 9A:
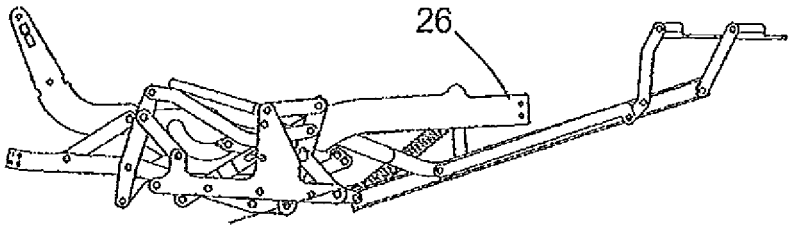
Figure 9B:
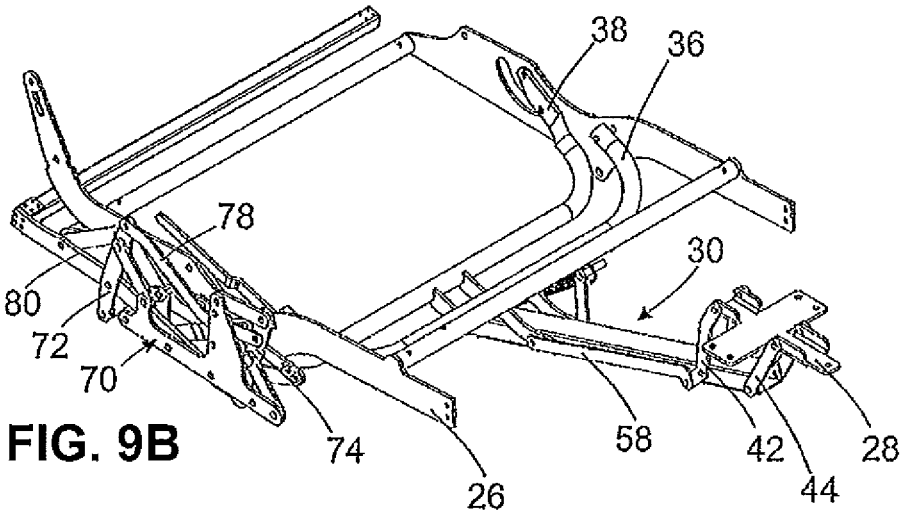
Figure 10A:
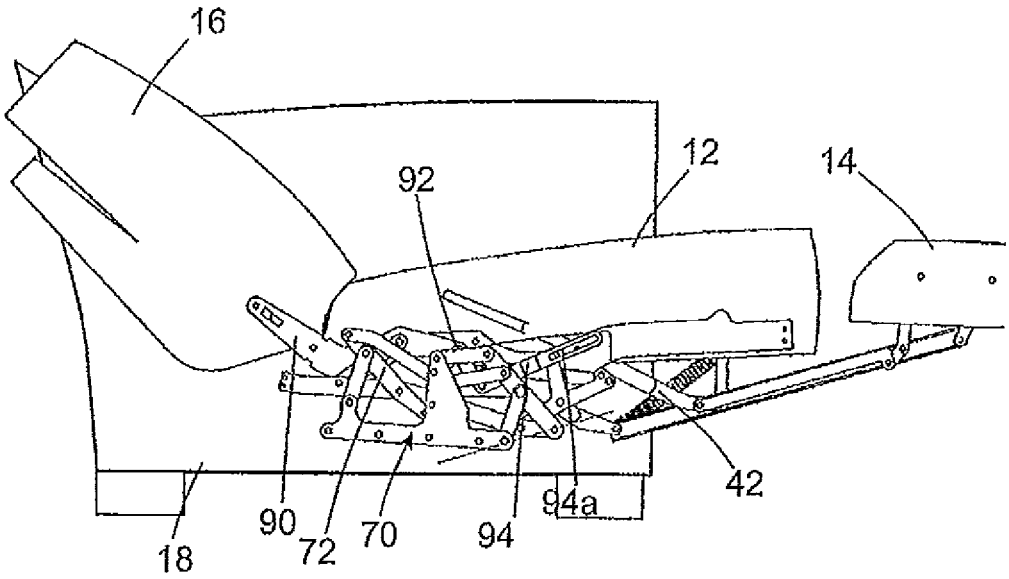
Figure 10B:
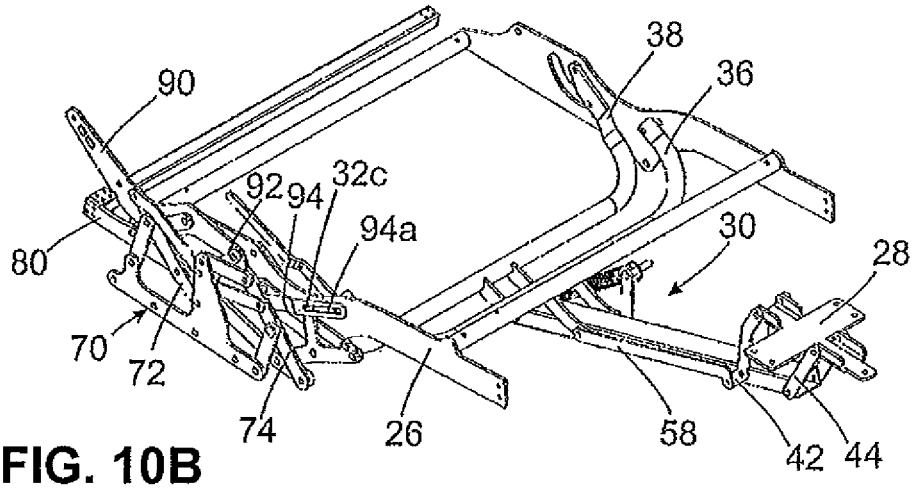

The desired almost linear movability of the pivot axis 74*a* in relation to the attachment strip 71 is achieved in that the distances between the pivot axes 74*a* and 74*b*, between the pivot axes 74*b* and 75*a*, and between the pivot axes 74*b* and 74*c* are correspondent to one another or almost correspondent. In FIGS. 9A and 10A, this is illustrated by a dotted line. Just as do the slotted guide tracks 18*b*, 18*c* of the previous embodiment, the dotted line has an inclination of approximately 15° with a forward rising slope.

With regard to the rear movement lever 72, also a construction with two levers is provided in an alternative embodiment. In order to save space, however, in the embodiment shown, a somewhat different configuration has been selected which uses the already defined movability of the front movement lever 74 by means of a coupling lever 78. Indeed, with the intermediate lever 73 an intermediate lever having the same effect as the intermediate lever 75 is provided at the rear movement lever 72. However, a lever corresponding to the intermediate lever 76 was dispensed with. Instead, it is achieved by means of the mentioned coupling lever 78 that the movement path of the pivot axis 72*a* is approximately oriented parallel to the movement path of the pivot axis 74*a*.

In the outcome, the lever system 70 is thus capable of replacing the slotted guide tracks 18*b*, 18*c* of the previous exemplary embodiment. The lever system 70 ensures an almost identical relative movability of the displacement unit 80 in relation to the base 18.

Unlike the configuration of FIGS. 4A to 6B, also the attachment of the backrest support 90 is effected. For this purpose, the aforementioned control lever 92 is provided in a manner similar to the embodiment of FIGS. 1A to 3B. However, the lever cannot be pivotably coupled to the displacement unit 80 in a manner corresponding to FIGS. 1A to 3B, since this would counteract an additional pivotability during the transition from the second use state to the third use state, because during the transition, there is no relative displacement of the backrest pivot axis 34*a* in relation to the displacement unit 80.

Therefore, in a manner that can be seen from FIG. 7, the control lever 92 is instead pivotably attached around the pivot axis 72*d* to the rear movement lever 72.

The transferability of the item of seating furniture from the first use state into the second use state and further into the third use state resulting from the structure described, essentially corresponds to the transferability in the preceding exemplary embodiment.

Starting from the first use state of FIGS. 8A and 8B, a forward displacement of the seat unit 12 together with its frame 26 in relation to the elements of the displacement unit 80 which initially remain fixed in position to one another and the lever system 70 attached fixed to the base leads to the extension of the leg unit in the same manner as in the preceding exemplary embodiments. Upon reaching the second use state of FIGS. 9A and 9B, a further forward displacement of the seat unit and a force application to the backrest and thus to the backrest support 90, due to the operative coupling by means of the control lever 92, will result in a displacement of the pivot axes 74*a*, 72*a* forwards in an approximately linear manner and slightly rising manner (as indicated by the dotted line) in relation to the attachment strip 71 fixed to the base, wherein at the same time, a pivoting of the backrest 16 is achieved. In the final state of FIGS. 10A, 10B, which is the third use state, the item of seating furniture allows a comfortable reclined position.

The embodiments are to be understood as exemplary and merely serve to illustrate the invention and the partial aspects thereof. It is obvious to the person skilled in the art that variations of the embodiments are possible without leaving the scope of the invention.

In that context, explicit reference is made to that different embodiments are conceivable and are within the scope of the invention in which parts of the fitting can be provided merely on one side of the seat surface or on both sides of the seat surface. The components ensuring the relative movabilities are in one embodiment, but not in a mandatory way, provided on both sides. This applies in particular to the connections of the pivot levers 36, 38 to the frame 26 of the seat unit, for connecting the frame 26 to the attachment strips 24 or to the displacement units 80 by means of the displacement levers 32, 34 and it applies to the slotted guide systems 18*a*, 18*b*, 18*c*, 82*a*, 82*b*, 96 or the corresponding lever system 70, respectively. Other components leading to the coupling of the relative movabilities are in one embodiment present on one side, but could also be provided symmetrically on both sides. This applies, for example, to the transmission lever 58 for coupling the pivoting guides, to the coupling lever 40 for operative coupling of the movement of the intermediate support 30 with the seat frame 26 and to the control lever 92 for operative coupling of the movement of the seat frame 26 or of the displacement unit 80 with the movement of the backrest unit 16.

Furthermore, it is obvious to the person skilled in the art that the techniques described in this case are illustrated only exemplary by means of a single chair, but can also be used one time or several times with sofas.

It is also obvious to the person skilled in the art that an item of furniture according to the invention can include further partial units which can be fixed in position to the described partial units or which can be separately moveable in relation to these parts. Included therein are in particular arm rests which can be provided fixed in position to the seat unit.

Furthermore, the person skilled in the art can conceive that the specifically named components which are provided fixed in position to the different units, to the base, the seat unit, the leg unit and the backrest unit, are to be understood as exemplary. Thus, for example the attachment strips 24, 71 and the side parts of the base, the seat frame 26, the intermediate support 30, the support 28 and the backrest support 90 can be replaced by other components which are suitable for attaching the respective functional elements, such as in particular levers and slotted guide tracks, without departing from the scope of the invention.

The invention claimed is:

1. An item of seating furniture, comprising:

a base fixed in position during the use of the item of seating furniture;

a seat unit with a seat surface; and a leg unit moveable in relation to the seat unit and having a leg support surface;

wherein the leg unit is displaceable by a movement mechanism between a storage position wherein the leg support surface is arranged under the seat unit and a use position wherein the leg support surface is arranged in front of the seat unit;

wherein the movement mechanism is designed for transferring the leg unit from the storage position wherein the leg support surface is oriented substantially horizontally into the use position wherein the leg support surface is likewise oriented substantially horizontally;

wherein the movement mechanism has an intermediate support;

wherein the intermediate support is displaceable in relation to the seat unit or the base by a first pivoting guide, wherein the first pivoting guide has at least one first rear pivot lever between the intermediate support and the seat unit or the base;

wherein the leg unit is displaceable relative to the intermediate support by a second pivoting guide, wherein the second pivoting guide comprises at least one first front pivot lever between the intermediate support and the leg unit;

wherein the base and the seat unit are attached to one another by a displacement unit, wherein said displacement unit can be moved in relation to the base and wherein the seat unit can be moved in relation to the displacement unit, wherein the displacement unit can be displaced relative to the base starting from a base position along a movement path forwards; and wherein the movement path is linear or approximately linear and/or the movement path has a forward rising slope and/or wherein for displacing the displacement unit in relation to the base, a lever system is provided which comprises at least one movement lever pivotably coupled to the displacement unit and guided by at least two intermediate levers which are pivotably coupled to the base.

2. The item of seating furniture according to claim 1, wherein the at least one first rear pivot lever of the first pivoting guide is coupled to the seat unit or the base so as to be pivotable firstly about a first pivot axis and is coupled to the intermediate support so as to be pivotable secondly about a second pivot axis.

3. The item of seating furniture according to claim 2, wherein each pivoting position of the at least one first rear pivot lever of the first pivoting guide in relation to the seat unit or in relation to the base is associated with a resultant pivoting position of the intermediate support in relation to the at least one first rear pivot lever, and wherein the first pivoting guide for this purpose further comprises a second rear pivot lever coupled to the seat unit or to the base so as to be pivotable about a third pivot axis spaced apart from the first pivot axis; and also is coupled to the intermediate support so as to be pivotable about a fourth pivot axis spaced apart from the second pivot axis.

4. The item of seating furniture according to claim 3, wherein the at least one first rear pivot lever remains completely to a rear of a front edge of the seat surface irrespective of a position of the intermediate support, and the second rear pivot lever remains completely to the rear of the front edge of the seat surface irrespective of the position of the intermediate support.

5. The item of seating furniture according to claim 1, wherein the at least one first front pivot lever of the second pivoting guide is pivotably coupled at a first end thereof to the intermediate support around a fifth pivot axis and at a second end thereof to the leg unit around a sixth pivot axis.

6. The item of seating furniture according to claim 5, wherein each pivot position of the at least one first front pivot lever relative to the intermediate support causes a relative pivot position of the leg unit relative to the intermediate support, wherein the second pivoting guide further comprises a second front pivot lever, the second front pivot lever being pivotably coupled to the intermediate support around a seventh pivot axis spaced apart from the fifth pivot axis and to the leg unit around an eighth pivot axis spaced apart from the sixth pivot axis.

7. The item of seating furniture according to claim 6, wherein:

the fifth pivot axis and the sixth pivot axis of the at least one first front pivot lever have a first distance to one another that is different from a second distance between the seventh pivot axis and the eighth pivot axis of the second front pivot lever; and/or the at least one first front pivot lever and the second front pivot lever each have a differing orientation.

8. The item of seating furniture according to claim 1, wherein the at least one first rear pivot lever of the first pivoting guide is coupled to the at least one first front pivot lever of the second pivoting guide such that a first pivot movement of the at least one first rear pivot lever relative to the seat unit or to the base causes a second pivot movement of the at least one first front pivot lever of the second pivoting guide relative to the intermediate support and thus a movement of the leg unit relative to the intermediate support.

9. The item of seating furniture according to claim 8, wherein the at least one first rear pivot lever and the at least one first front pivot lever are coupled to one another such that opposed pivot movements are achieved.

10. The item of seating furniture according to claim 1, wherein the seat unit is designed to be displaceable in relation to the base of the item of seating furniture, wherein relative movement of the seat unit in relation to the base is operatively coupled to relative movement of the intermediate support in relation to the seat unit, wherein movability of the seat unit in relation to the base is provided by two displacement levers which are each coupled pivotably to the base and to the seat unit.

11. The item of seating furniture according to claim 1, wherein when the item of seating furniture includes the lever system, the at least two intermediate levers comprise a first and second intermediate lever and the at least one movement lever is coupled to the base by the first and second intermediate levers, wherein the following three distances differ from one another by at maximum 20%:

a first distance between a first pivot axis around which the first intermediate lever is coupled to the at least one movement lever and a second pivot axis around which the at least one movement lever is pivotably attached to the displacement unit;

a second distance between the first pivot axis around which the first intermediate lever is coupled to the at least one movement lever and a third pivot axis around which the at least one movement lever is pivotably attached to the second intermediate lever; and a third distance between the first pivot axis around which the first intermediate lever is coupled to the at least one movement lever and a fourth pivot axis around which the first intermediate lever is pivotably attached to the base.

12. The item of seating furniture according to claim 1, wherein the item of seating furniture can be transferred between:

a first use state wherein the leg unit is in the storage position thereof;

a second use state wherein the leg unit is in the use position thereof; and a third use state, wherein the leg unit is in the use position thereof and a backrest has a first orientation closer to the horizontal in relation to a second orientation in the second use state.

13. The item of seating furniture according to claim 1, wherein:

a backrest unit can be pivoted around a backrest axis in relation to the seat unit, wherein the backrest axis can be displaced in relation to the base together with the seat unit; and a backrest guidance system is provided, the backrest unit being pivoted around the backrest axis by the backrest guidance system depending on a relative position of the seat unit to the base and/or a relative position of the displacement unit to the base.

14. The item of seating furniture according to claim 13, wherein when the item of seating furniture includes the lever system, the at least two intermediate levers comprise a first and second intermediate lever and wherein the backrest guidance system comprises a control lever attached to the backrest unit eccentrically to the backrest axis, with a first side of the control lever being pivotably attached to the backrest unit and a second side of the control lever being pivotably attached to the base or to the at least one movement lever.

15. The item of seating furniture according to claim 12, further including:

a first blocking system wherein, in the storage position of the leg unit, a first displacement of the displacement unit in relation to the base is blocked; and/or a second blocking system wherein, in the third use state, a second displacement of the leg unit in relation to the seat unit is blocked.

16. An item of seating furniture, comprising:

a base fixed in position during use of the item of seating furniture;

a seat unit with a seat surface; and a leg unit moveable in relation to the seat unit and having a leg support surface;

wherein the leg unit is displaceable by a movement mechanism between a storage position wherein the leg support surface is arranged under the seat unit and a use position wherein the leg support surface is arranged in front of the seat unit;

wherein the movement mechanism is designed for transferring the leg unit from the storage position wherein the leg support surface is oriented substantially horizontally into the use position wherein the leg support surface is likewise oriented substantially horizontally;

wherein the movement mechanism has an intermediate support;

wherein the intermediate support is displaceable in relation to the seat unit or the base by a first pivoting guide, wherein the first pivoting guide has at least one first rear pivot lever between the intermediate support and the seat unit or the base;

wherein the leg unit is displaceable relative to the intermediate support by a second pivoting guide, wherein the second pivoting guide comprises at least one first front pivot lever between the intermediate support and the leg unit;

wherein the at least one first rear pivot lever of the first pivoting guide is coupled to the at least one first front pivot lever of the second pivoting guide such that a first pivot movement of the at least one first rear pivot lever relative to the seat unit or to the base causes a second pivot movement of the at least one first front pivot lever of the second pivoting guide relative to the intermediate support and thus a movement of the leg unit relative to the intermediate support;

wherein the at least one first rear pivot lever of the first pivoting guide and the at least one first front pivot lever of the second pivoting guide are connected to one another by a control rod, wherein the at least one first rear pivot lever of the first pivoting guide is coupled to the intermediate support so as to be pivotable about a first pivot point and the at least one first front pivot lever of the second pivoting guide is coupled to the intermediate support so as to be pivotable about a second pivot point, wherein said control rod, relative to a virtual boundary line connecting the first pivot point and the second pivot point, is coupled to the at least one first rear pivot lever on a first side of the boundary line and is coupled to the at least one first front pivot lever on a second opposite side of the boundary line.

17. The item of seating furniture according to claim 16, wherein the base and the seat unit are attached to one another by a displacement unit, wherein said displacement unit can be moved in relation to the base and wherein the seat unit can be moved in relation to the displacement unit, wherein the displacement unit can be displaced relative to the base starting from a base position along a movement path forwards; and wherein the movement path is preferably linear or approximately linear and/or the movement path has a forward rising slope and/or wherein, for displacing the displacement unit in relation to the base, a slotted guide system is provided which comprises at least one slotted guide track in which at least one guide slider or one guide roller is arranged.

18. The item of seating furniture according to claim 16, wherein:

a backrest unit can be pivoted around a backrest axis in relation to the seat unit, wherein the backrest axis can be displaced in relation to the base together with the seat unit;

a backrest guidance system is provided, the backrest unit being pivoted around the backrest axis by the backrest guidance system depending on a relative position of the seat unit to the base and/or a relative position of the displacement unit to the base; and the backrest guidance system comprises at least one slotted guide track, in which a guide slider or a guide roller is arranged.

* * * * *